US005302486A

United States Patent [19]

Patel et al.

[11] Patent Number: 5,302,486

[45] Date of Patent: Apr. 12, 1994

[54] ENCAPSULATED TONER PROCESS UTILIZING PHASE SEPARATION

[75] Inventors: Raj D. Patel; Guerino G. Sacripante, both of Oakville; Grazyna Kmiecik-Lawrynowicz, Burlington, all of Canada

[73] Assignee: Xerox Corporation, Stamford, Conn.

[21] Appl. No.: 870,375

[22] Filed: Apr. 17, 1992

[51] Int. Cl.[5] ..... G03G 9/08

[52] U.S. Cl. ..... 430/137; 430/138

[58] Field of Search ..... 430/137, 138

[56] References Cited

U.S. PATENT DOCUMENTS

| | | | |
|---|---|---|---|
| 2,800,457 | 7/1957 | Green et al. | 252/316 |
| 2,800,458 | 7/1957 | Green | 252/316 |
| 4,465,756 | 8/1984 | Mikami et al. | 430/138 |
| 4,520,091 | 5/1985 | Kakimi et al. | 430/110 |
| 4,626,489 | 12/1986 | Hyosu | 430/137 |
| 4,636,451 | 1/1987 | Matkin et al. | 430/109 |
| 4,642,281 | 2/1987 | Kakimi et al. | 430/138 |
| 4,727,011 | 2/1988 | Mahabadi et al. | 430/138 |
| 4,761,358 | 8/1988 | Hosoi et al. | 430/109 |
| 4,816,366 | 3/1989 | Hysou et al. | 430/137 |

FOREIGN PATENT DOCUMENTS

| | | | |
|---|---|---|---|
| 2-287552 | 11/1990 | Japan | G036/9/48 |

*Primary Examiner*—Steve Rosasco
*Attorney, Agent, or Firm*—E. O. Palazzo

[57] ABSTRACT

A process for the preparation of an encapsulated toner composition comprised of a core and a shell thereover, which process comprises mixing an organic phase comprised of an olefinic monomer, pigment, and a first resin A soluble in the organic phase; dispersing the organic phase into microdroplets in an aqueous solution comprised of a surfactant; subjecting the resulting mixture to free radical polymerization by heating wherein the olefinic monomer is converted to a second resin B; and wherein said resin B is incompatible with said resin A and phase separates whereby a core and shell results.

23 Claims, No Drawings

ENCAPSULATED TONER PROCESS UTILIZING PHASE SEPARATION

BACKGROUND OF THE INVENTION

The present invention is generally directed to toner processes, and more specifically to processes for the preparation of encapsulated toner compositions. In one embodiment, the present invention is related to a process for the preparation of encapsulated toners comprised of a core and a shell, and wherein the process comprises mixing an olefinic monomer, a free radical initiator, a pigment, an optional charge control agent, and a polymer resin A soluble in the organic phase; dispersing this mixture in an aqueous medium containing a surfactant, and heating the resultant stabilized microdroplet to effect the free radical polymerization of the olefinic monomer to polymer resin B, wherein both resin A and B are incompatible and phase separate to form a shell and core morphology. In another embodiment, the present invention is related to a process for the preparation of encapsulated toners comprised of a mixture of an olefinic monomer, such as for example isobutyl methacrylate or styrene, a free radical initiator, a pigment, and optionally a charge control agent, and a condensation polymer resin A such as a polyester, a polyurea, a polyamide, or polyurethane soluble in the organic phase; dispersing this mixture in an aqueous medium containing a surfactant; and heating the resultant stabilized microdroplet to effect the olefinic polymerization of the olefinic monomer to resin B, yielding an encapsulated toner wherein the condensation polymer resin A and the polymer resin B phases are incompatible and separate such that a shell and core morphology is obtained. Accordingly, in one embodiment of this invention, the condensation polymer A phase separates to the surface of the microcapsule toner resulting in a condensation polymer shell, such as a polyester shell, and the core is comprised of the addition-type polymer resin B, such as poly(isobutyl methacrylate), pigment and optionally a charge control additive. In other embodiments, the addition-type polymer, such as the aforementioned poly(isobutyl methacrylate) resin B phase separates to the microcapsule surface, and the core is comprised of pigment, an optional charge control agent and the condensation polymer, such as a polyester. The primary advantages associated with the processes of the present invention in embodiments is that the condensation polymer resin is not formed by an interfacial polymerization as illustrated, for example, in U.S. Pat. Nos. 4,000,087 and 4,307,169, the disclosures of which are totally incorporated herein by reference. Thus, with the processes of the present invention there is avoided the use of undesirable toxic diacid chlorides, and diisocyanate monomers to form condensation polymers, and there is avoided the generation of byproducts associated with interfacial condensation polymerization such as inorganic salts or organic salts such as sodium chloride, hydrogen chloride alkylamino chlorides, and the like. Additionally, with the process of this invention, there are obtained encapsulated toners comprised of a core comprised of a condensation polymer such as a polyester, pigment and charge control, and comprised thereover a shell consisting of an addition-type polymer resin such as poly(isobutylmethacrylate) or polystyrene. The aforementioned polystyrene shell-polyester core, for example, cannot be readily obtained by known prior art processes, and the processes of the present invention are advantageous for obtaining excellent pigment dispersion of from about 70 to about 100 percent transmittance. Excellent pigment dispersion can be measured by fusing an image on transparency and acquiring the projection efficiency using a Match Scan II photospectrometer. Furthermore, with the process of this invention, encapsulated toners with low heat fusibility, excellent triboelectrification and admix, high projection efficiency, high gloss, nonblocking, nonghosting and nonsmearing properties are obtained.

It is known that encapsulated toners offer numerous advantages over conventional pulverization processes. The conventional pulverization process involves melt mixing of the toner ingredients such as a resin, pigment and charge control, followed by extrusion, grinding and energy consuming jetting process to obtain the desired volume average particle size of from about 7 microns to about 21 microns as measured by the Coulter Counter. Additionally, for the aforementioned particle size to remain unchanged until required for fixing on paper by reprographic methods, the glass transition temperature of the conventional toner should be not less than 50° C., and preferably not less than 55° C. after manufacturing, transporting or storage. This glass transition temperature of the toner can restrict the type of fuser rolls utilized in reprographic fixing systems and a fusing temperature of no less than 150° C. and preferably no less than 160° C. such that the toner can be fixed adequately onto paper. Encapsulated toner process enables, for example, the preparation of a core with a glass transition temperature of from about −70° C. to about 50° C. and surrounded by a shell material of glass transition temperature of above 50° C. The primary function of the shell is to prevent toner agglomeration until used during the fixing step, at which time shell rupture by the application of pressure by the fusing roll is accomplished thereby releasing the core resin primarily responsible for sticking, fixing and adhering to the paper. Accordingly, one main advantage of encapsulated toners is that they can be fixed adequately onto paper at lower roll fusing temperatures, such as from about 100° C. to about 130° C., thereby reducing the energy consumption of the fuser as well as prolonging its lifetime. Additionally, encapsulated toner processes can offer other advantages over conventional processes, such as the ability to produce smaller size toner of less than 7 microns necessary for higher resolution in reprographic applications. Many prior art encapsulated toner compositions utilize condensation polymers as the shell component, such as a polyester or a polyurethane, which can be obtained by the interfacial condensation of diisocyanate or diacid chloride monomer with diols, amines, aminoethers and the like, and causing the generation of byproducts such as salts and hydrolyzed diacid chloride or diisocyanate monomers. The encapsulated toner processes of this invention do not utilize expensive and toxic reagents such as diisocyanates or diacid chlorides, and do not generate byproducts in embodiments. Additionally, with the process of this invention in embodiments there can be obtained encapsulated toners comprised of a core comprised of a condensation polymer of low glass transition of less than 50° C., such as a polyester, pigment and charge control, and thereover a shell comprised of an addition-type polymer resin, such as poly(isobutylmethacrylate) or polystyrene, with a glass transition temperature of above 50° C. not readily, if attainable with prior art processes.

Certain encapsulated toners and processes thereof are known. For example, both U.S. Pat. No. 4,626,489 and British Patent Publication 1,538,787 disclose similar processes for colored encapsulated toners wherein the core resins are prepared by free radical polymerization and the shell materials are prepared by interfacial polymerization. U.S. Pat. No. 4,565,764 discloses a colored microcapsule toner comprised of a colored core encapsulated by two resin shells with the inner shell having an affinity for both the core and the outer shell materials. Also mentioned primarily as background interest are U.S. Pat. Nos. 4,671,954; 4,644,030; 4,482,606 and 4,309,213. Disclosed in U.S. Pat. No. 4,636,451 is a process for the preparation of encapsulated toners wherein the shell or condensation polymer resin is prepared by interfacial reaction involving diacid chlorides or diisocyanates. The present invention does not utilize an interfacial polymerization to form the condensation polymer resin, thereby avoiding the use of toxic diacid chlorides and diisocyanates and avoiding the generation of undesireable byproducts associated with the interfacial condensation. Also, U.S. Pat. No. 4,797,339 discloses a toner comprising an inner layer of ion complex and an outer layer containing a flowability imparting agent; and U.S. Pat. No. 4,254,201 illustrates the use of pressure sensitive toner clusters or aggregates with each granule of the cluster or aggregate being comprised of a pressure sensitive adhesive substance encapsulated by coating film. Color pigment particles or magnetic particles can be present on the surfaces of the encapsulated granules to impart the desired color to the toners. Also, U.S. Pat. No. 4,727,011 discloses a process for preparing encapsulated toners which involves a shell forming interfacial polycondensation and a core forming free radical polymerization, and further U.S. Pat. No. 4,708,924 discloses the use of a mixture of two polymers, one having a glass transition temperature in the range of −90° C. to 5° C., and the other having a softening temperature in the range of 25° C. to 180° C. as the core binders for a pressure fixable encapsulated toner. Other prior art, all United States patents, are summarized below: U.S. Pat. No. 4,016,099, which discloses methods of forming encapsulated toner particles and wherein there are selected organic polymers including homopolymers and copolymers such as vinylidene fluoride, tetrafluoroethylene, chlorotrifluoroethylene, and the like, see column 6, beginning at line 3, wherein there can be selected as the core materials polyolefins, polytetrafluoroethylene, polyethylene oxide and the like, see column 3, beginning at around line 18; U.S. Pat. No. 4,265,994 directed to pressure fixable capsule toners with polyolefins, such as polytetrafluoroethylene, see for example column 3, beginning at line 15; U.S. Pat. No. 4,497,885, which discloses a pressure fixable microcapsule toner comprising a pressure fixable component, a magnetic material, and other optional components, and wherein the core material can contain a soft material, typical examples of which include polyvinylidenefluoride, polybutadiene, and the like, see column 3, beginning at line 10; U.S. Pat. No. 4,520,091, which discloses an encapsulated toner with a core which comprises a colorant, a dissolving solvent, a nondissolving liquid and a polymer, and may include additives such as fluorine containing resin, see column 10, beginning at line 27; U.S. Pat. No. 4,590,142 relating to capsule toners wherein additives such as polytetrafluoroethylenes are selected as lubricating components, see column 5, beginning at line 52; U.S. Pat. Nos. 4,520,091; 4,642,281; 4,761,358; 4,599,289 and 4,803,144.

With further specific reference to the prior art, there are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. Furthermore, there are disclosed in U.S. Pat. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent.

The disclosures of all the United States patents and other patent documents mentioned herein are totally incorporated herein by reference.

A number of United States patents and copending patent applications illustrate various encapsulated toner compositions and processes thereof, such as interfacial shell formation processes including, for example, U.S. Pat. No. 5,043,240, U.S. Pat. No. 5,035,970, U.S. Pat. No. 5,037,716 and U.S. Ser. No. 516,864, U.S. Pat. No. 5,045,253, U.S. Ser. No. 546,616, U.S. Ser. No. 456,278, U.S. Ser. No. 461,397, U.S. Pat. No. 5,082,757, U.S. Ser. No. 617,222, U.S. Pat. No. 5,023,159, U.S. Pat. No. 5,013,630, and U.S. Ser. No. 782,688, wherein there is disclosed, for example, a toner composition comprised of a homogeneous or substantially homogeneous mixture of polymer resin or resins, and color pigments, dyes, or mixtures thereof overcoated with a component derived from the condensation of a cellulose polymer with a silane component, the disclosures of each of the aforementioned copending applications and patents being totally incorporated herein by reference.

SUMMARY OF THE INVENTION

It is an object of the present invention to provide encapsulated toner compositions and processes thereof with many of the advantages illustrated herein.

In another object of the present invention there are provided processes for two component encapsulated toner compositions comprised of a core comprised of a core polymer or polymers, and a pigment, and a shell which is not formed by an interfacial polymerization and thus avoids the disadvantages thereof as indicated herein.

In yet another object of the present invention there are provided in situ processes for the preparation of encapsulated toner compositions comprised of a core comprised of an addition polymer resin and colorants, and a polymeric shell comprised of a condensation polymer.

In another object of the present invention there are provided in situ processes for the preparation of encapsulated toner compositions comprised of a core comprised of a condensation polymer and colorants or pigments, and a polymeric shell comprised of an addition type polymer resin.

A further object of the present invention is to provide encapsulated toners with excellent admix characteristics, and acceptable powder flow characteristics.

An additional object of the present invention is the provision of colored encapsulated toners exhibiting low fusing properties, thus enabling lowering of the fusing temperature thereof.

A further object of the present invention is to provide a simple preparative process for small sized toners with narrow size distribution without the need to resort to conventional pulverization and classification techniques.

A further object of the present invention is to provide encapsulated toners with excellent toner shelf life stability; and to provide (1) in situ toners capable of passivation with minimal or no colorant or pigment present on the toner surface, (2) nonblocking toners, and (3) high or low gloss characteristics.

The process of the present invention in embodiments comprises the mixing of an organic phase comprised of a dispersed pigment, optionally a charge control agent, an olefinic monomer or plurality of monomers, polymerization initiators, and a condensation polymer such as a polyester resin soluble in the organic phase; thereafter dispersing the organic phase in an aqueous solution containing dispersant and surfactant to generate microdroplets, and followed by heating to effect the free-radical polymerization of the monomer. During the polymerization of the olefinic monomer or after completion of this polymerization, the ensuing or resulting polymer is not compatible with the condensation polymer and phase separation of the two resins occur. Although not desired to be limited by theory, because of the polar nature of the aqueous solution, it is believed that the more polar resin materials of the microcapsule migrates to the surface forming the shell and the less polar resin forms the core. Additionally, the pigment and optionally charge control agent is dispersed within the microcapsule, or preferably only with the core resin such that passivation can be achieved. In embodiments, the condensation polymer can be gelled, cured, or reinforced by crosslinking by, for example, heating the dispersion in the presence of a known crosslinker or by the free radical initiator employed for the polymerization of the addition-type monomer.

In one embodiment, the colored encapsulated toner composition can be prepared by (i) mixing a monomer such as styrene from about 0.35 mole, isobutyl methacrylate from about 0.55 mole, n-lauryl methacrylate from about 0.1 mole, a colorant such as HELIOGEN BLUE TM from about 0.01 mole to about 0.015 mole, free radical initiators such as VAZO 67 TM, a 2,2'-azo-bis-(2,4-dimethylvaleronitrile), from about 0.001 mole to about 0.003 mole, and a condensation polymer resin such as poly(propoxylated bisphenol A-fumarate) of from about 0.2 mole to about 0.5 mole; (ii) dispersing this homogeneous mixture using a high shearing device such as a Brinkmann 45G probe at from about 8,000 to about 10,000 rpm for a duration of from about 30 to about 120 seconds in a vessel containing from about a 0.5 liter to about 0.75 liter of water, dissolved therein a cellulose surfactant such as methylethylhyroxy cellulose of from about 0.75 to about 1 percent by weight of water, and an ionic surfactant such as sodium dodecylsulfate of from about 0 to 0.04 percent by weight of water; (iii) heating the mixture to effect free radical polymer formation, from about 60° C. to about 95° C., and for a duration of from about 360 minutes to about 720 minutes. The ensuing free radical polymer is believed to phase separate from the condensation resin and migrate to the surface forming the shell, and condensation resin forming the core comprised of the dispersed pigment as evidenced by tunneling electron microscopy (FIG. 1). The toner product is then washed by centrifugation from about 4 to about 6 times, and dried using preferably a fluidized bed operated at about 30° C. to about 60° C. for a duration of from about 240 minutes to about 480 minutes. Flow additives to improve flow characteristics may then optionally be employed, such as AEROSIL R-200 ® and the like, of from about 0.1 to about 10 percent by weight of toner.

In embodiments, the present invention is directed to a process for the preparation of an encapsulated toner composition comprised of a core and a shell thereover, which process comprises mixing an organic phase comprised of an olefinic monomer, pigment, and a first resin A soluble in the organic phase; dispersing the organic phase into microdroplets in an aqueous solution comprised of a surfactant; subjecting the resulting mixture to free radical polymerization by heating wherein the olefinic monomer is converted to a second resin B; and wherein said resin B is incompatible with said resin A and phase separates whereby a core and shell result.

Examples of olefinic monomers selected and present in effective amounts of, for example, from about 10 to about 95, and preferably from about 40 to about 90 percent by weight, include aliphatic unsaturated hydrocarbons with, for example, 2 to about 25 carbon atoms, and preferably 1 to 12 carbon atoms, such as acrylic, methacrylic, styryl and olefinic polymers. Suitable addition monomers for the core resin-forming free radical polymerization can be selected from the group consisting of methyl acrylate, methyl methacrylate, ethyl acrylate, ethyl methacrylate, propyl acrylates, propyl methacrylates, butyl acrylates, butyl methacrylates, pentyl acrylates, pentyl methacrylates, hexyl acrylates, hexyl methacrylates, heptyl acrylates, heptyl methacrylates, octyl acrylates, octyl methacrylates, cyclohexyl acrylate, cyclohexyl methacrylate, lauryl acrylates, lauryl methacrylates, stearyl acrylates, stearyl methacrylates, benzyl acrylate, benzyl methacrylate, ethoxypropyl acrylate, ethoxypropyl methacrylate, methylbutyl acrylates, methylbutyl methacrylates, ethylhexyl acrylates, ethylhexyl methacrylates, methoxybutyl acrylates, methoxybutyl methacrylates, cyanobutyl acrylates, cyanobutyl methacrylates, tolyl acrylate, tolyl methacrylate, styrene, substituted styrenes, other substantially equivalent addition monomers, and, other known addition monomers, reference for example U.S. Pat. No. 4,298,672, the disclosure of which is totally incorporated herein by reference, and mixtures thereof. The olefin monomer is converted into a second resin, or resin B.

Various known colorants including magnetic pigments like magnetites, and present in effective amounts of, for example, from about 0.1 to about 60, and preferably from about 2 to about 7 weight percent, may be selected for the processes of the present invention. Typical magnetic pigments include Mobay magnetites MO8029 TM, MO8060 TM; Columbian MAPICO BLACKS ® and surface treated magnetites; Pfizer magnetites CB4799 TM, CB5300 TM, CB5600 TM, MCX636 TM; Bayer magnetites BAYFERROX 8600 TM, 8610 TM; Northern Pigments magnetites, NP-604 TM, NP-608 TM; Magnox magnetites TMB-100 TM or TMB-104 TM, iron oxides, and the like. Examples of other colorants inclusive of dyes and color pigments, preferably present in an effective amount of, for example, from 0.1 to about 10 weight percent of toner, include carbon black, like REGAL 330 ® carbon blacks available from Cabot Corporation, PALIOGEN VIOLET 5100 TM and 5890 TM (BASF), NORMANDY MAGENTA RD-2400 TM (Paul Uhlich), PERMA- NENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED (Aldrich), Scarlet for THERMOPLAST NSD RED TM (Aldrich), Lithol Rubine Toner (Paul Uhlich), LITHOL SCARLET 4440 TM (BASF), BON RED C TM (Dominion Color), ROYAL BRILLIANT RED RD-8192 TM (Paul Uhlich), ORACET PINK RF (Ciba Geigy), PALIOGEN RED 3340 TM and 3871K TM (BASF), LITHOL FAST SCARLET L4300 TM (BASF), HELIOGEN BLUE D6840 TM, D7080 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), Irgalite Blue BCA (Ciba Geigy), PALIOGEN BLUE 6470 TM (BASF), SUDAN TM II, III and IV (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), Novoperm Yellow FGL (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1355 TM and D1351 TM (BASF), HOSTAPERM PINK E TM (Hoechst), FANAL PINK D4830 TM (BASF), Cinquasia Magenta (DuPont), PALIOGEN BLACK L0084 TM (BASF), PIGMENT BLACK K801 TM (BASF) and carbon blacks such as REGAL 330 ® (Cabot), Carbon Black 5250 and 5750 (Columbian Chemicals). Generally, known cyan, magenta, yellow, red, green, and the like color pigments can be selected.

Illustrative examples of condensation resins, that is first resin A, selected for the process of the present invention include polyesters such as polyethylene-terephthalate, polypropylene-terephthalate, polybutylene-terephthalate, polypentylene-terephthalate, polyhexalene-terephthale, polyheptadene-terephthalate, polyoctalene-terephthalate, polyethylene-sebacate, polypropylene sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(-propoxylated bisphenol-fumarate), poly(propoxylated bisphenol-succinate), poly(propoxylated bisphenol-adipate), poly(propoxylated bisphenol-glutarate), SPAR TM (Dixie Chemicals), GLYPTAL TM, ALKYDAL TM, BECKOSOL TM (Reichhold Chemical Inc.), CRESTALKYD TM, DURECOL TM, EPOK TM, MITHALAC TM, PARALAC TM, PLASTOKYD TM, PLUSOL TM, SCOPLA TM, SCOPLUX TM, SOALKYD TM, SYNOLAC TM, SYNRESAT TM, VIKYD TM, WRESINOL TM, ARAKOTE TM (Ciba-Geigy Corporation), HETRON TM (Ashland Chemical), ARTRITE TM, CRYSTIC TM, FILABOND TM, MARCO TM, PALATAL TM, PARAPLEX TM (Rohm & Hass), POLYLITE TM (Reichhold Chemical Inc.), PLASTHALL TM (Rohm & Hass), CYGAL TM (American Cynamide), ARMCO TM (Armco Composites), ARPOL TM (Ashland Chemical), CELANEX TM (Celanese Chemical), RYNITE TM (E. I. DuPont), STYPOL TM (Freeman Chemical Corporation), SYNRES TM, VIBRIN TM, mixtures thereof and the like; polycarbonates such as LEXAN TM (G. E. Plastics), LEXEL TM, MAKROLON TM (Mobay), MERLON TM (Mobay), PANLITE TM (Teijin Chemical), mixtures thereof and the like; polyurethanes such as PELLETHANE TM (Dow), ESTANE TM (Goodyear), CYTOR TM (American Cyanimide), TEXIN TM (Mobay), Vibrathane TM (Uniroyal Chemical), CONATHANE TM (Conap Company), mixtures thereof, and the like.

Illustrative examples of suitable surfactants or stabilizers selected for the process of the present invention include poly(vinyl alcohols), partially hydrolyzed poly(vinyl alcohols), alkyl with, for example, 1 to 15 carbon atoms, celluloses like methyl cellulose, ethyl cellulose, hydroxypropyl cellulose, hydroxyethylmethyl cellulose, and the like. The effective concentration of surfactant in the aqueous medium ranges, for example from about 0.1 percent by weight to about 5 percent by weight, with the preferred amount being determined primarily by the nature of the toner precursor materials and the desired toner particle diameter size of, for example, 2 microns to about 20 microns. In embodiments, inorganic surfactants may also be utilized in combination with the organic surfactant for achieving a smaller microdroplet size of, for example, less than about 9 microns in average volume diameter, and more specifically, from 1 to about 8 microns. Illustrative specific examples of suitable inorganic surfactants include barium sulfate, lithium phosphate, tricalcium phosphate, potassium oleate, potassium caprate, potassium stearate, sodium laurate, sodium dodecyl sulfate, sodium oleate, sodium laurate, colloidal silica, and the like. The concentration of inorganic surfactant, that is effective in reducing the microdroplet size to below 9 microns, that is for example from about 3 to about 7 microns in embodiments, ranges, for example, from about 0.005 to about 1.0 percent by weight, and preferably from about 0.01 to about 0.20 percent by weight.

Suitable free radical initiators selected for the core resin-forming free radical polymerization include azo-type initiators such as 2-2'-azobis-(dimethylvaleronitrile), azobis-(isobutyronitrile), azobis-(cyclohexanenitrile), azobis-(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl-2,5-bis-(2-ethylhexanoylperoxy)hexane, di-tert-butyl peroxide, cumene hydroperoxide, dichlorobenzoyl peroxide, and mixtures thereof, with the quantity of initiator being, for example, from about 0.1 percent to about 10 percent by weight of that of core monomer. Water soluble free radical inhibitors can also be employed to, for example, suppress or inhibit emulsion polymerization in the aqueous phase.

Surface additives can be selected for the toners of the present invention including, for example, metal salts, metal salts of fatty acids, colloidal silicas, powdered metal oxides, mixtures thereof, and the like, which additives may be present in an amount of from about 0.1 to about 5 weight percent, reference U.S. Pat. Nos.

3,590,000; 3,720,617; 3,655,374 and 3,983,045, the disclosures of which are totally incorporated herein by reference. Preferred additives include zinc stearate, AEROSIL R972 ® and powdered metal oxides.

In embodiments, known charge control or conductive additives can be applied to the surface of toners to control, respectively, their triboelectric and electroconductive characteristics. Illustrative examples of charge control additives include known powdered conductive metal oxides like tin oxide, quaternary ammonium salts, organometallic complexes or salts of salicylic acids and catechols, and the like. Exemplary conductive additives include carbon blacks, graphites, conductive metal oxides, and the like. The aforementioned components can be present in various effective amounts, such as for example from about 0.1 to about 3 weight percent.

For two component developers, known carrier particles including steel ferrites, copper zinc ferrites, nickel zinc ferrites, and the like, with or without coatings, can be admixed with, for example, from about 1 to about 5 parts of toner per about 100 parts of carrier with the encapsulated toners of the present invention, reference for example the carriers illustrated in U.S. Pat. Nos. 4,937,166; 4,935,326; 4,883,736; 4,560,635; 4,298,672; 3,839,029; 3,847,604; 3,849,182; 3,914,181; 3,929,657 and 4,042,518, the disclosures of which are totally incorporated herein by reference.

In one embodiment of the present invention, the colored encapsulated toner composition can be prepared by (i) mixing about 0.35 mole of styrene, about 0.55 mole of isobutyl methacrylate, about 0.1 mole of n-lauryl methacrylate, about 0.06 of a colorant such as HELIOGEN BLUE TM (BASF), about 0.002 mole of a free radical initiator, such as 2,2'-azobis-(2,4-dimethylvaleronitrile) and about 0.35 of a polyester such as poly(propoxylated bisphenol A-fumarate); (ii) dispersing this mixture using a high shearing device such as a Brinkmann 45G probe at about 8,000 rpm for a duration of about 120 seconds in a vessel containing from about 0.75 liter of water, dissolved therein about 1.0 percent by weight of methylethylhydroxy cellulose, and about 0.01 of an ionic surfactant such as sodium dodecylsulfate; and (iii) heating the resulting mixture to effect free radical polymer formation at an effective temperature of, for example, from about 60° C. to about 95° C. and for an effective time of, for example, about 720 minutes. The toner product can then be washed about six times by centrifugation, and dried using preferably a fluidized bed operated at a temperature of from about 30° C. for a duration of about 480 minutes. There results an encapsulated toner comprised of about 26 percent by weight of polyester resulting from poly(propoxylated bisphenol A-fumarate), about 4.5 percent by weight of HELIOGEN BLUE K7090 TM pigment and about 71 percent by weight of poly(styrene-n-laurylmethacrylate-isobutyl-methacrylate).

The encapsulated toners of the present invention can be utilized in various imaging systems as mentioned herein including, more specifically, those wherein latent images are developed on an imaging member, and subsequently transferred to a supporting substrate and affixed thereto by cold pressure rollers, heat and/or a combination of heat and pressure.

The following Examples are being submitted to further define various species of the present invention. These Examples are intended to be illustrative only and are not intended to limit the scope of the present invention.

EXAMPLE I

A 7 micron (average volume particle diameter) cyan colored encapsulated toner comprised of a core containing the polyester, poly(propoxylated bisphenol A-fumarate), and HELIOGEN BLUE TM pigment and a shell comprised of the addition-type polymer poly(isobutylmethacrylate) was prepared as follows.

A mixture of 235.0 grams of isobutyl methacrylate, 80 grams of poly(propoxylated bisphenol A-fumarate) resin and 15 grams of HELIOGEN BLUE K7090 TM (BASF) pigment was ball milled for 24 hours. To this mixture was added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred (100) grams of the resulting mixture were then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, about 25° C., the reaction product was washed repeatedly with water until the aqueous phase was clear, and the product was then freeze dried for 24 hours. The resulting toner product (245 grams) was comprised of about 24 percent by weight of the polyester poly(propoxylated bisphenol A-fumarate), about 4.5 percent by weight of HELIOGEN BLUE K7090 TM pigment and about 70 percent by weight of poly(isobutyl methacrylate) shell. This toner evidenced a volume average particle diameter of 7.0 microns, and a particle size distribution of 1.38 according to Coulter Counter measurements. Furthermore, a sample, about 25 grams, of this toner was freeze fractured in liquid nitrogen, stained with ruthenium oxide, and the particle size diameter of a cross section of the microcapsule was evidenced by tunneling electron microscope to be 6.95 microns, and was comprised of a poly(isobutyl methacrylate) shell of about 0.45 micron in thickness, and a core comprised of the above dispersed blue pigment, and the aforementioned polyester core of about 3.3 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and a transparency substrate and fixed with heat, and the minimum fixing temperature, as determined by the crease method of this toner, was found to be 155° C.

EXAMPLE II

A 6.5 micron cyan colored encapsulated toner comprised of a core containing a polyester and HELIOGEN BLUE TM pigment and a shell comprised of the addition-type polymer poly(styrene-n-butylmethacrylate) was prepared as follows.

A mixture of 120.0 grams of n-butylmethacrylate, 80 grams of styrene, 80 grams of poly(propoxylated bisphenol-fumarate) resin and 15 grams of HELIOGEN BLUE K7090 TM (BASF) pigment was ball milled for 24 hours. To this mixture were added 3.0 grams each of two free radical initiators, 2,2'-azobis-(2,4-dimethylvaleronitrile) and 2,2'-azobis(isobutyronitrile), and the mixture was roll blended until all the free radical initiators were dissolved. One hundred and fifty (150) grams of the resulting mixture was then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product (140 grams) was comprised of about 24 percent by weight of the polyester poly(propoxylated bisphenol-fumarate), about 4.5 percent by weight of pigment and about 70 percent by weight of poly(isobutyl methacrylate). This toner evidenced a volume average particle diameter of 6.5 microns, and a particle size distribution of 1.42 according to Coulter Counter measurements. Furthermore, a sample of this toner, about 10 grams, was freeze fractured in liquid nitrogen, stained with ruthenium oxide, and the particle size diameter of a cross section of the microcapsule was evidenced by tunneling electron microscope to be 6.3 microns, and composed of a poly(styrene-n-butylmethacrylate) shell of about 0.41 micron in thickness, and a core comprised of dispersed pigment and the polyester core of about 2.9 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U. S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and transparency substrate and fixed with heat, and the minimum fixing temperature as determined by the crease test of this toner was found to be 150° C.

EXAMPLE III

A 7.3 micron magenta colored encapsulated toner comprised of a core containing a polyester and HOSTAPERM PINK E TM pigment and a shell comprised of the addition-type poly(styrene-iso-butyl methacrylate-n-lauryl methacrylate) was prepared as follows.

A mixture of 129.0 grams of isobutyl methacrylate, 23.5 grams of n-lauryl methacrylate, 82.2 grams of styrene, 80 grams of poly(propoxylated bisphenol-succinate) polyester resin and 15 grams of HOSTAPERM PINK E TM (Hoechst) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product (245 grams) comprised of about 24 percent by weight of the polyester of poly(propoxylated bisphenol-succinate), about 4.5 percent by weight of pigment and about 70 percent by weight of poly(styrene-isobutylmethacrylate-n-laurylmethacrylate). This toner evidenced a volume average particle diameter of 7.3 microns, and a particle size distribution of 1.32 according to Coulter Counter measurements. Furthermore, a sample of this toner was freeze fractured in liquid nitrogen, stained with ruthenium oxide, and the particle size diameter of a cross section of the microcapsule was evidenced by tunneling electron microscope to be 7.1 microns, and composed of a poly(styrene-iso-butylmethacrylate-n-laurylmethacrylate) shell of about 0.49 micron in thickness, and a core comprised of dispersed pigment and the polyester core of about 3.12 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and transparency substrate and fixed with heat, and the minimum fixing temperature of this toner was found to be 150° C.

EXAMPLE IV

A 5 micron magenta colored encapsulated toner comprised of a core containing a polyester poly(propoxylated bisphenol-succinate) and HOSTAPERM PINK EB TM pigment and a shell comprised of the addition-type poly(isobutylmethacrylate) was prepared as follows.

A mixture of 235.0 grams of isobutyl methacrylate, 80 grams of poly(propoxylated bisphenol-succinate), and 15 grams of HOSTAPERM PINK EB TM (Hoechst) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product (245 grams) was comprised of about 24 percent by weight of the polyester poly(propoxylated bisphenol-succinate), about 4.5 percent by weight of pigment and about 70 percent by weight of poly(isobutyl methacrylate). This toner evidenced a volume average particle diameter of 5 microns, and a particle size distribution of 1.35 according to Coulter Counter measurements. Furthermore, a sample of this toner was freeze fractured in liquid nitrogen, stained with ruthenium oxide, and the particle size diameter of a cross section of the microcapsule was evidenced by tunneling electron microscope to be 4.8 microns, and composed of a poly(isobutyl methacrylate) shell of about 0.4 micron in thickness, and a core comprised of dispersed pigment and the polyester core of about 2.4 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and transparency substrate and fixed with heat, and the minimum fixing temperature of this toner was found to be 160° C.

EXAMPLE V

An 8 micron magenta colored encapsulated toner comprised of a core containing the addition-type poly(isobutylmethacrylate) and a shell comprised of polyvinyl pyrrolidinone was prepared as follows.

A mixture of 295.0 grams of isobutyl methacrylate, 20 grams of polyvinyl pyrrolidinone, and 15 grams of HOSTAPERM PINK EB TM (Hoechst) pigment was ball milled for 24 hours. To this mixture were added 5.5 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product (245 grams) was comprised of about 6 percent by weight of polyvinyl pyrrolidinone, about 4.5 percent by weight of pigment and about 89 percent by weight of poly(isobutyl methacrylate). This toner evidenced a volume average particle diameter of 8 microns, and a particle size distribution of 1.36 according to Coulter Counter measurements. Furthermore, a sample of this toner was freeze fractured in liquid nitrogen, stained with ruthenium oxide, and the particle size diameter of a cross section of the microcapsule was evidenced by tunneling electron microscope to be 7.9 microns, and composed of a polyvinyl pyrrolidinone shell of about 0.2 micron in thickness, and a core comprised of dispersed pigment and poly(isobutylmethacrylate) of about 3.8 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and transparency substrate and fixed with heat, and the minimum fixing temperature of this toner was found to be 160° C.

EXAMPLE VI

A 4.9 micron cyan colored encapsulated toner comprised of a core containing the addition-type poly(isobutyl methacrylate) and a shell comprised of polyvinylpyridine was prepared as follows.

A mixture of 295.0 grams of isobutyl methacrylate, 20 grams of polyvinyl pyrrolidinone, and 15 grams of HELIOGEN BLUE (BASF) pigment was ball milled for 24 hours. To this mixture were added 5.5 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous methylethylhydroxy cellulose solution and 0.005 percent of sodium dodecylsulfate, and the resulting mixture was homogenized for 2 minutes using a Brinkmann polytron operating at 10,000 rpm. The mixture was then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle product (245 grams) was comprised of about 6 percent by weight of polyvinylpyridine, about 4.5 percent by weight of pigment and about 89 percent by weight of poly(isobutyl methacrylate). This toner evidenced a volume average particle diameter of 4.9 microns, and a particle size distribution of 1.32 according to Coulter Counter measurements. Furthermore, a sample of this toner was freeze fractured in liquid nitrogen, stained with ruthenium oxide, and the particle size diameter of a cross section of the microcapsule was evidenced by tunneling electron microscope to be 4.9 microns, and composed of a polyvinylpyridine shell of about 0.1 micron in thickness, and a core comprised of dispersed pigment and polyisobutyl methacrylate of about 2.4 microns as measured from the center of the microcapsule to the inner boundary of the shell.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to a paper and transparency substrate and fixed with heat, and the minimum fixing temperature of this toner was found to be 160° C.

The ferrite selected for all the working Examples, unless otherwise noted, is comprised of a nickel zinc ferrite with a coating thereover, 0.75 weight percent, which ferrite can be obtained from, for example, Steward Chemicals.

Other modifications of the present invention may occur to those skilled in the art subsequent to a review of the present application. The aforementioned modifications, including equivalents thereof, are intended to be included within the scope of the present invention.

What is claimed is:

1. A phase separation process for the preparation of an encapsulated toner composition consisting essentially of a core and a shell thereover, which process consists essentially of mixing an organic phase comprised of an olefinic monomer, pigment, and a first resin A soluble in the organic phase; dispersing at a temperature of from about 5° C. to about 60° C. the organic phase into microdroplets in an aqueous solution comprised of a surfactant; subjecting the resulting mixture to free radical polymerization by heating at a temperature of from about 35° C. to about 120° C. wherein the olefinic monomer is converted to a second resin B; and wherein said resin B is incompatible with said resin A and phase separates whereby a core and shell results, and wherein said shell is formed from said second resin B which migrates to the surface of the toner.

2. A process in accordance with claim 1 wherein the first resin A is the core and is selected from the group consisting of polyester, polycarbonate, polyamide, and polyurethane, and the second resin B separates to the surface of the resulting toner to form the shell.

3. A process in accordance with claim 2 wherein the pigment is cyan, yellow, magenta, red, green, blue, brown pigments, or mixtures thereof.

4. A process in accordance with claim 2 wherein the thickness of the polymer shell is from about 0.001 to about 2 microns.

5. A process in accordance with claim 2 wherein the core is a polymer selected from the group consisting of a polyurea, a polyester, a polyurethane, a polyamide, and mixtures thereof.

6. A process in accordance with claim 1 wherein the resin A is a polyester, polyvinyl pyrrolidinone, polyvinylpyridine, polycarbonate, polyamide, or polyurethane and phase separates from resin B to form the shell of the microcapsule, and the resin B phase separates to form the core of the toner.

7. A process in accordance with claim 1 wherein resin B is a polymer selected from the group consisting of methyl methacrylate, ethyl methacrylate, propyl methacrylate, butyl methacrylate, pentyl methacrylate, hexyl methacrylate, 2-ethyl hexyl methacrylate, dodecyl methacrylate, decyl methacrylate, nonyl methacrylate, lauryl methacrylate, stearyl methacrylate, styrene, isobutyl methacrylate, n-butyl methacrylate, butyl acrylate, and mixtures thereof.

8. A process in accordance with claim 1 wherein the dispersion is accomplished at a temperature of from about 5° C. to about 60° C.

9. A process in accordance with claim 1 wherein the free radical polymerization is accomplished at a temperature of from about 35° C. to about 120° C.

10. A process in accordance with claim 1 wherein resin A is a condensation polymer selected from the group consisting of a polyurethane, a polyester, a polyamide, a polyether, a polyurea, a polycarbonate and mixtures thereof.

11. A process in accordance with claim 1 wherein the pigment is dispersed in the core in an amount of from about 1 percent by weight to about 15 percent by weight of the toner.

12. A process in accordance with claim 1 wherein the shell comprises from about 5 to about 15 weight percent of the toner; the pigment comprises from about 2 to about 7 weight percent of the toner; and the core polymer comprises from about 40 to about 90 percent of the toner, and wherein the average volume particle size diameter of the encapsulated toner is from about 0.5 micron to about 25 microns.

13. A process in accordance with claim 1 wherein resin B is an addition polymer.

14. A process in accordance with claim 13, wherein resin B is a polymer selected from the group consisting of styrene, acrylate, and methacrylate polymers, and wherein the average volume particle size diameter of the encapsulated toner is from about 2 microns to about 7 microns.

15. A process in accordance with claim 1 wherein the pigment is a magnetite, cyan, yellow, magenta, red, green, blue, brown pigments, or mixtures thereof.

16. A process in accordance with claim 1 wherein the toner obtained is blended with surface additives and the core is a polymer selected from the group consisting of poly(acrylate), poly(methacrylate), polystyrene, poly(styrene-acrylate), poly(styrene-methacrylate), poly(styrene-butadiene), and mixtures thereof.

17. A process in accordance with claim 16 wherein the surface additives are comprised of conductive metal oxides, metal salts, metal salts of fatty acids, colloidal silica, quaternary ammonium salts, sulfonamides, sulfonimides, organometallic complexes, or mixtures thereof.

18. A process in accordance with claim 16 wherein the additives are present in an amount of from about 0.1 to about 10 weight percent of the toner.

19. A process in accordance with claim 1 wherein the shell is a polymer selected from the group consisting of a polyurea, a polyester, a polyurethane, a polyamide, a polyvinylpyridine, a polyvinyl pyrrolidinone, and mixtures thereof.

20. A process in accordance with claim 1 wherein the surfactant is selected from the group consisting of methylethyl cellulose, hydroxyethylmethyl cellulose, hydroxypropylmethyl cellulose, hydroxymethyl cellulose, polyvinyl alcohol, polyacrylic acid, polymethacrylic acid, polyvinyl acetate, potassium oleate, potassium caprate, potassium stearate, sodium laurate, sodium dodecylsulfate, sodium oleate, sodium laurate, sodium dodecylbenzylsulfonate, dialkylbenzyl ammonium chloride, and mixtures thereof.

21. A substantially nontoxic process for the preparation of an encapsulated toner composition with a core and a shell thereover, which process consists essentially of mixing an organic phase comprised of an olefinic monomer, pigment, and a first resin A soluble in the organic phase; dispersing at a temperature of from about 5° C. to about 60° C. the organic phase into microdroplets in an aqueous solution containing a surfactant; subjecting the resulting mixture to free radical polymerization by heating at a temperature of from about 35° C. to about 120° C. wherein the olefinic monomer is converted to a second resin B; and wherein said resin B is incompatible with said resin A and phase separates whereby a core and shell results, which shell is formed from resin B and is a polymer selected from the group consisting of methyl methacrylate, ethyl methacrylate, propyl methacrylate, butyl methacrylate, pentyl methacrylate, hexyl methacrylate, 2-ethyl hexyl methacrylate, dodecyl methacrylate, decyl methacrylate, nonyl methacrylate, lauryl methacrylate, stearyl methacrylate, styrene, isobutyl methacrylate, n-butyl methacrylate, butyl acrylate, and mixtures thereof; and wherein said dispersing is accomplished at a temperature of from about 5° C. to about 60° C.

22. A process in accordance with claim 21 wherein the core is comprised of a condensation polymer with a low glass transition temperature of less than about 50° C.

23. A process in accordance with claim 21 wherein there results an encapsulated toner with a fusing temperature of from about 100° C. to about 130° C.

* * * * *